United States Patent [19]

Sanger

[11] 4,232,419

[45] Nov. 11, 1980

[54] ARTICULATED PLUMBERS SNAKE

[76] Inventor: Winston D. Sanger, 12600 Cuddy Valley Rd., Frazier Park, Calif. 93225

[21] Appl. No.: 23,587

[22] Filed: Mar. 26, 1979

[51] Int. Cl.[3] ..... B08B 9/02

[52] U.S. Cl. ..... 15/104.3 SN; 59/87; 403/182

[58] Field of Search ..... 15/104.3 R, 104.3 SN; 59/87; 403/182, 213, 287

[56] References Cited

U.S. PATENT DOCUMENTS

| | | | |
|---|---|---|---|
| 165,010 | 6/1875 | Manning | 403/182 |
| 1,604,542 | 10/1926 | Wieland | 403/182 |
| 1,661,487 | 3/1928 | McCullar | 59/87 |
| 3,397,420 | 8/1968 | Schneider | 15/104.3 SN |
| 4,104,757 | 8/1978 | Silverman | 15/104.3 SN |

*Primary Examiner*—Edward L. Roberts

[57] ABSTRACT

A sectional plumbers snake with a power driven end section having one end provided with a shank received in the tool holding chuck of a power drill, the other sections of the snake having complementary detachable connections permitting the addition of sections immediately in front of the power driven section.

2 Claims, 15 Drawing Figures

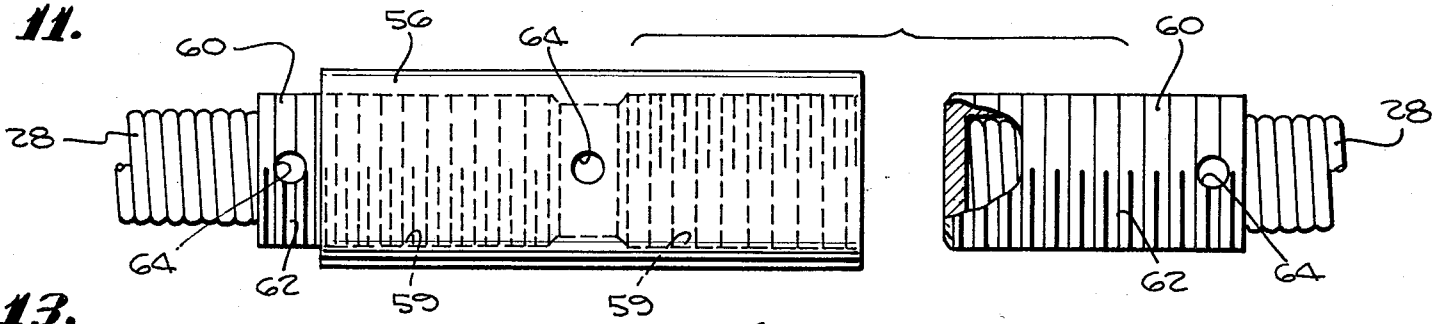
Fig. 11.
Fig. 12.
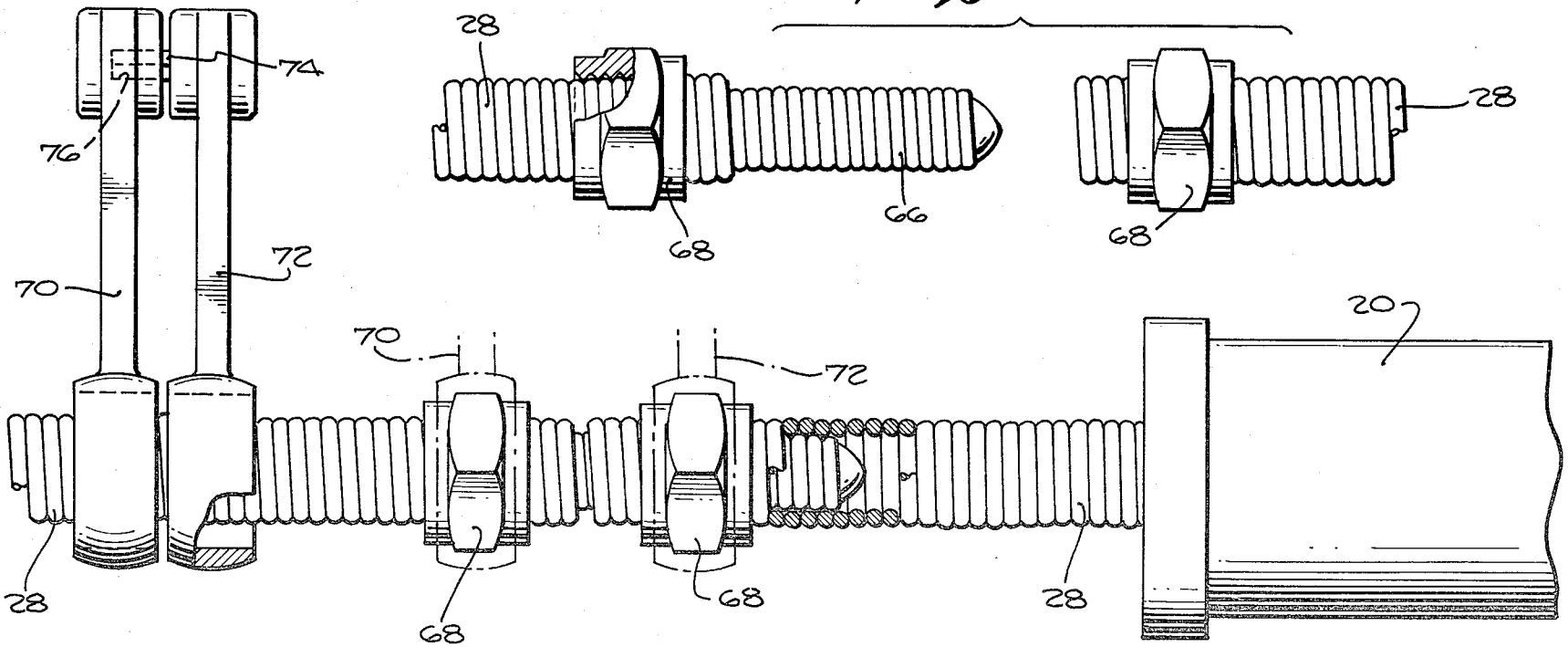
Fig. 13.

ARTICULATED PLUMBERS SNAKE

FIELD OF INVENTION

The device is used to clean out clogged pipes, particularly in and around the home. It is one which can be economically produced, is in sections so that it can be stored compactly and is intended to be used in lengths which can be efficiently rotated with an ordinary hand drill powered by electricity, although it is contemplated that an air motor can be utilized as well.

PRIOR ART

U.S. Pat. No. 2,557,119 issued June 19, 1951 to Kjerulff shows a plumbers snake with spaced swivel connections which cannot be separated, the snake being fed through the specially constructed handle and chuck of a tool similar to a hand rotated drill.

U.S. Pat. No. 2,880,435 granted Apr. 7, 1959 to Deutsch and U.S. Pat. No., 3,043,121 issued July 10, 1962 to Truman show sectional plumbers snakes.

U.S. Pat. No. 266,421 issued Oct. 24, 1882 to Blake and U.S. Pat. No. 779,890 issued Jan. 10, 1905 to Ulery show snap hooks for connecting straps and are not intended to transmit torsional forces.

DISCLOSURE

Several forms of the invention are illustrated in the drawings.

FIG. 11 is an exploded view of another form of detachable connection.

FIG. 12 is an elevational view of the end portions of another embodiment.

FIG. 13 is a side elevational view of an end of a pipe to be cleaned, with the embodiment of FIG. 12, showing the nut tightening and snake guiding wrenches in different functional positions in broken and full lines.

Figure 1:
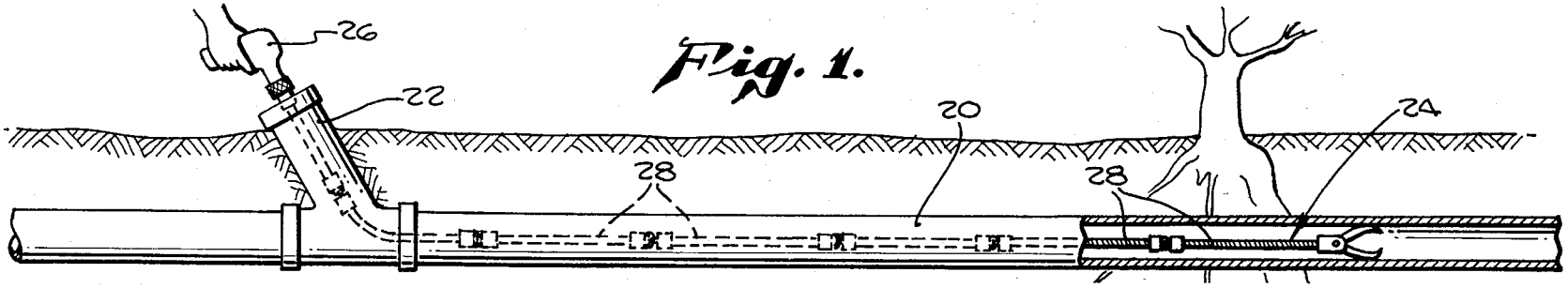
FIG. 1 is a view through a section of ground showing portions of a pipe system and an embodiment of the invention in side elevation and also in broken lines.

In FIG. 1 there is shown an underground pipe 20 having a clean out branch 22. In the pipe is a general representation of my plumbers snake 24 whose above ground end is connected to and driven by a portable electric drill 26. The snake 24 is made up of a number of sections 28 which preferably are formed of coiled wire as indicated in FIG. 2 to provide resilient flexibility, or they may be of some other suitable material such as wire cable or coiled plastic.

Figure 2:
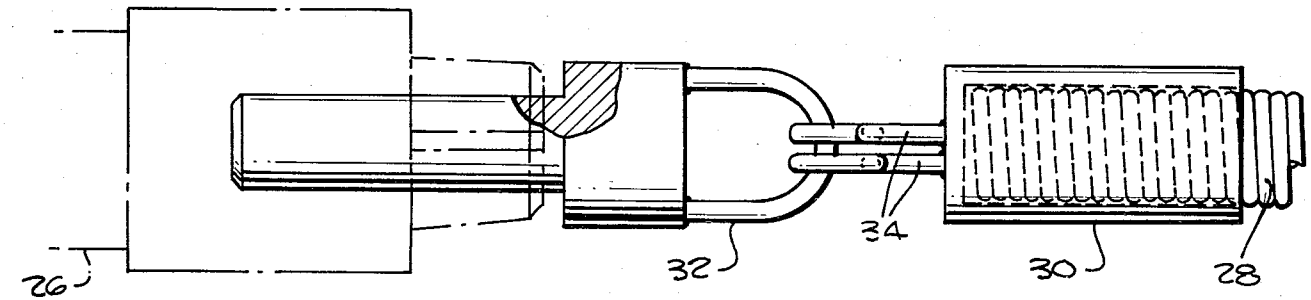
FIG. 2 is an enlarged detail of the power driven end of the snake with its shank received in a power drill chuck, the latter being in broken lines.
Figure 3:
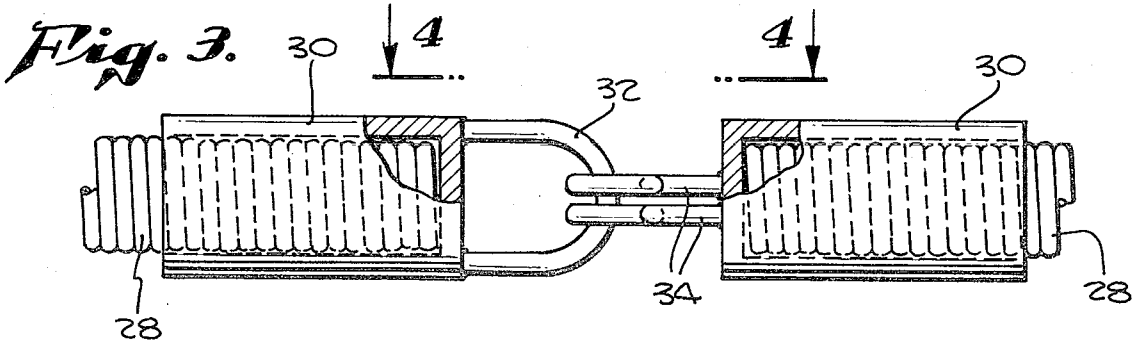
FIG. 3 is a view partially in side elevation and partially in section of complementary ends of two connected snake sections.
Figure 4:
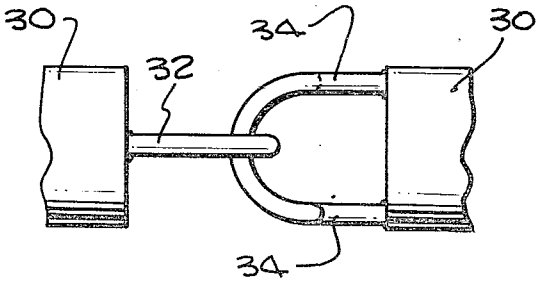
FIG. 4 is a fragmentary view in elevation, of the connected ends of FIG. 3, with said ends rotated 90 degrees.

The embodiment of FIGS. 2, 3 and 3 shows one form of end anchor and detachable connection for the sections. The adjacent ends of each section comprises a cup-like cap 30 into which the end of the coil section 28 is fitted and securely held by any suitable means such as welding, riveting or the like. One of the caps 30 is provided with a closed U-shaped loop 32 which is adapted to interconnect with a pair of closely spaced, oppositely directed parallel hook-like elements 34 which together comprise a split spring ring. The closed loop can be pushed between the hooks 34 when it is in a plane parallel to the hooks and then rotated 90 degrees to the relative positions shown in FIGS. 2, 3, and 4. The closed loop 32 can be released by counter-rotating it until it exerts a spreading force on the hooks 34 so that the loop 32 can be withdrawn from between the hooks.

Figure 5:
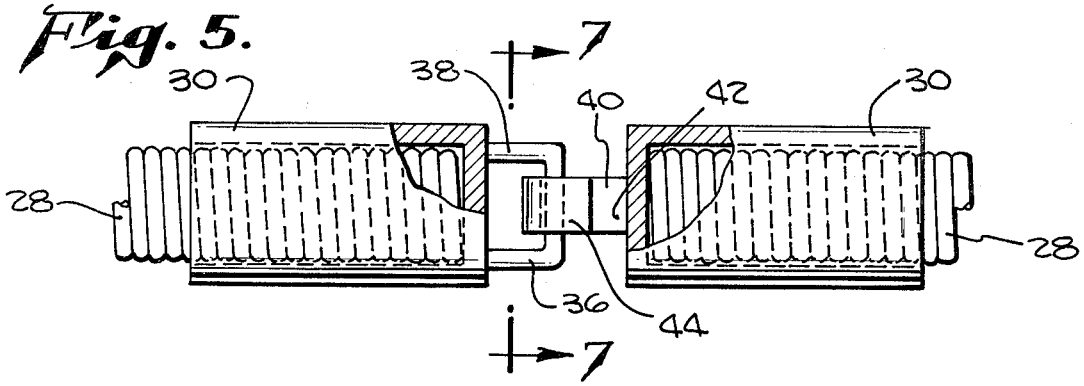
FIG. 5 is a detail partially in elevation and partially in section of adjacent ends of two sections with another form of detachable connection.
Figure 6:
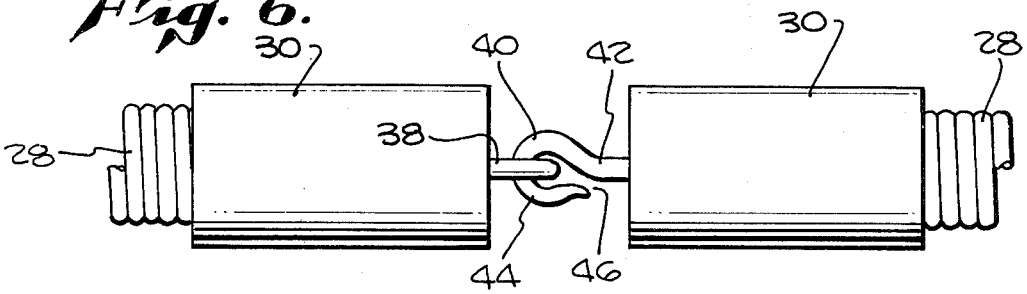
FIG. 6 is an elevational view of the connection of FIG. 5 with the ends rotated 90 degrees.
Figure 7:
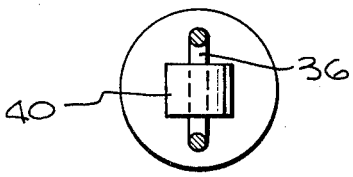
FIG. 7 is a sectional view taken approximately on line 7—7 of FIG. 5.

FIGS. 5–7 show another form of detachable connection. It includes a closed loop 36 of rectangular shape, providing a transverse cross-member 38 and a spring hook 40 comprising a flat tongue 42 bent upon itself as at 44, leaving a bight 46 which normally is somewhat smaller than the thickness of the material of the closed loop 38. Thus the closed loop 38 can be snapped into the hook 40 and held therein while being handled, but released therefrom by a deliberate pull of the transverse portion 38 of the closed loop outwardly through the bight 46.

Figure 10:
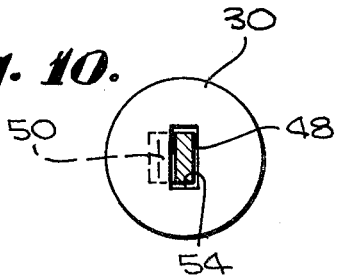
FIG. 10 is a sectional view approximately in line 10—10 of FIG. 9.
Figure 8:
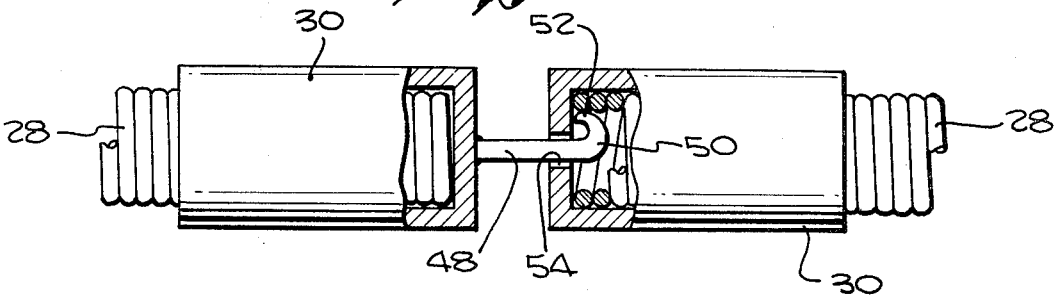
FIG. 8 is a view, partially in elevation and partially in section of adjacent end sections of the snake with a different form of detachable connection.
Figure 9:
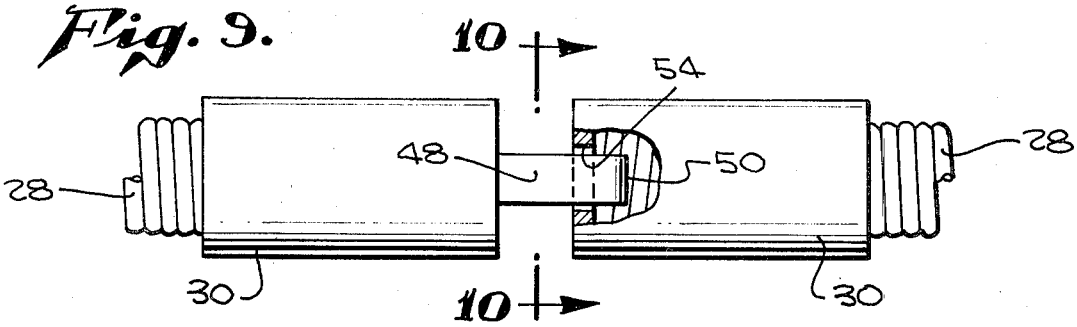
FIG. 9 is a view similar to FIG. 8 with the ends and their connections rotated 90 degrees.

FIGS. 8 through 10 illustrate another form of detachable connection. An end of one section is provided with an outwardly and axially extending tongue 48 which is curved upon itself as at 50, the extreme end being tapered so that it is somewhat thinner as at 52. The end of the adjacent section is provided with a rectangular slot 54. The curved end 50 of the tongue 48 can be inserted through the slot by positioning the adjacent ends of the sections at an acute angle so that the slot 54 will receive the curved end 50. Then the two sections 28 are brought generally into alignment so that the curved end 50 will lie inside of the slot.

FIG. 11 shows another form in which one end of a snake section 28 is welded or otherwise securely anchored in the left end of the sleeve 56. The right end of the sleeve is internally threaded as at 58. The adjacent end of the other section 28 is of less diameter than the one at the left of the figure and it is anchored in a sleeve 60 having external threads 62 which can be threaded into the internally threaded end of sleeve 56. Each of the sleeves 56 and 60 is provided with holes 64 to receive appropriate spanner-type wrenches for tightening and freeing the threaded connection.

FIGS. 12 and 13 show another form in which the left-hand snake section 28 of FIG. 12 is provided with a reduced tip 66 of such diameter that it can be threaded into the coil of the right snake section 28. Also on the exterior of each section 28 a nut 68 is threaded. When the reduced coil section 66 has been turned into the adjoining section at the right, the ends of the full diameters of sections 28 will abut. Then the right-hand nut 68 can be threaded to the left as viewed in FIG. 12 until it is in bridging engagement with the abutting ends of said sections. Thereupon the left-hand nut 68 can be drawn to the right into right abutment with the right-hand, locking them against accidental movement.

FIG. 13 illustrates in broken lines the manner in which a pair of wrenches 70 and 72 can be used to manipulate the nuts 68.

The wrenches 70 and 72 as shown in full lines can be utilized together as means for guiding the rotating snake as it is fed into the end of a pipe. The wrench 72 is provided with a square or hexagonal shank 74 which is adapted to be removably received in a complementary socket 76 in the end of the shank of the wrench 70. Thus the two wrenches are held against relative rotation and in alignment so they can properly guide and steady the snake where it is adapted to enter a pipe.

Figure 14:
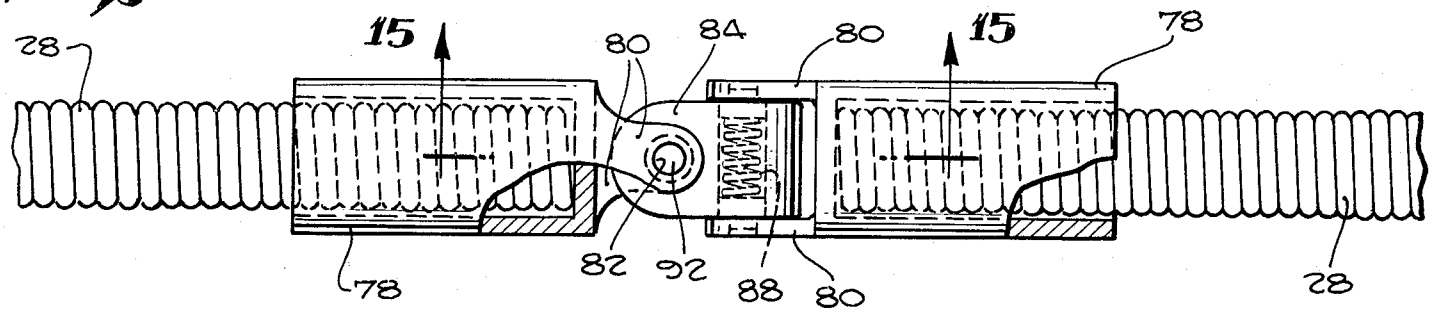
FIG. 14 is a view partly in section and partly in elevation of a universal joint connector for sections of the device.
Figure 15:
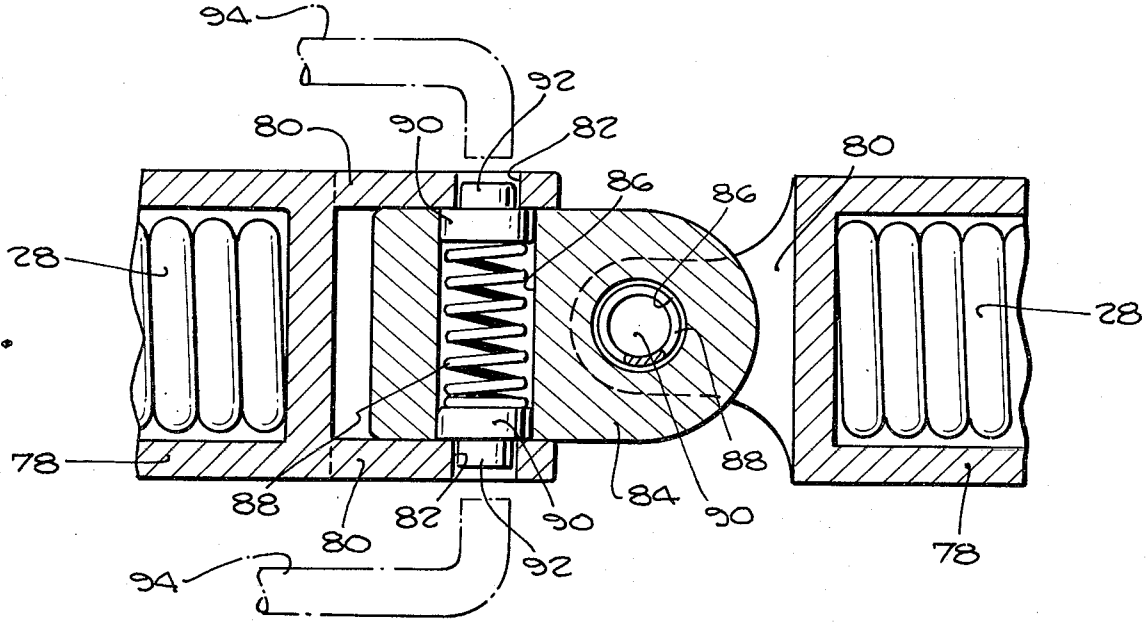
FIG. 15 is an enlarged view partially in section of one of the connector pins of the structure in FIG. 13.

In FIGS. 14 and 15 there is illustrated a universal type joint connecting adjacent sections of the articulated plumbers snake. Shown are socket elements 78 which preferably are internally threaded in the structure of FIG. 11, the sections 28 being secured in the sockets and by welding, not shown. Each socket 78 has a pair of spaced lugs 80 having apertures 82. The pairs of lugs on the respective sockets 78 are disposed at right angles to each other and received between them are the ends of a connector block 84. The block is provided with bores 86 therethrough which are spaced longitudinally and lie at right angles to each other. Located within each bore 86 is a compression spring 88, at each end of which, in the bore 86, is a short pin 90, each of said pins having a reduced end 92 extending into an aperture 82 in a lug 80. When the pins 90 are pressed inwardly against the spring 88 the connector block 84 can be separated from the lugs 80 on the end of a circuit 78. In FIG. 15 there is shown, in broken lines, a pair of arms 94 which can be pressed toward each other to depress pins 90 and release them from the apertures 82 in the spaced lugs 80.

It will be seen that I have provided an efficient extensible pipe cleaning plumbers snake which is particularly adapted for use by a householder who frequently has a variable speed power driven hand drill, so that the outlay is kept at a minimal while the advantages of a power driven snake are readily available.

It will of course be understood that various changes can be made in the form, details, arrangement and proportions of the various parts without departing from the spirit of the invention.

What is claimed is:

1. A powered plumbers snake comprising:

an elongated flexible water pipe cleaning element having a driven end section, a power hand tool having a rotary chuck and having a given direction of work rotation, the driven end section of said flexible water pipe cleaning element having an end portion comprising a shank removably clamped in said chuck, said flexible element, excepting said driven end section, comprising a plurality of additional sections having complementary detachable connections, said additional sections each having at one end, a closed loop, the other end of each such section having split spring ring means within which said closed loop is removably received, and said driven end section having its end opposite from the shank end, means for detachable connection selectively with one of said detachable connections.

2. The structure in claim 1, and the split spring ring means comprising a pair of closely spaced, oppositely directed parallel hook-like elements.

* * * * *